US009080781B1

(12) United States Patent
Turner

(10) Patent No.: US 9,080,781 B1
(45) Date of Patent: Jul. 14, 2015

(54) ADJUSTABLE SWIMMING POOL HEATER COVER SYSTEM

(76) Inventor: Donna M. Turner, Ellenton, FL (US)

( * ) Notice: Subject to any disclaimer, the term of this patent is extended or adjusted under 35 U.S.C. 154(b) by 932 days.

(21) Appl. No.: 13/200,278

(22) Filed: Sep. 22, 2011

(51) Int. Cl.

| | |
|---|---|
| ***B65D 65/02*** | (2006.01) |
| ***B65D 85/00*** | (2006.01) |
| ***F24F 1/58*** | (2011.01) |
| ***B65D 65/10*** | (2006.01) |
| ***B65D 27/00*** | (2006.01) |

(52) U.S. Cl.
CPC . *F24F 1/58* (2013.01); *B65D 27/00* (2013.01); *B65D 65/10* (2013.01)

(58) Field of Classification Search
CPC ..... B65D 27/00; F24F 1/58
USPC ..... 165/46, 134.1; 150/154, 158
See application file for complete search history.

(56) References Cited

U.S. PATENT DOCUMENTS

| | | | | |
|---|---|---|---|---|
| 2,455,237 | A * | 11/1948 | Davis | 410/97 |
| 4,954,384 | A * | 9/1990 | Hartwell | 428/100 |
| 4,976,301 | A * | 12/1990 | Easley et al. | 160/84.01 |
| 5,318,007 | A * | 6/1994 | Afshar | 122/18.4 |
| 5,470,648 | A * | 11/1995 | Pearlman et al. | 442/26 |
| 6,018,830 | A * | 2/2000 | Howe | 5/413 R |
| 6,478,157 | B1 * | 11/2002 | Witt et al. | 206/702 |
| 7,373,962 | B2 * | 5/2008 | Oubichon | 150/154 |
| 2003/0205601 | A1 * | 11/2003 | Kilduff | 224/627 |
| 2007/0227678 | A1 * | 10/2007 | Buechin | 160/348 |
| 2007/0289682 | A1 * | 12/2007 | Young | 150/154 |

* cited by examiner

*Primary Examiner* — Judy Swann
*Assistant Examiner* — Allison L Jernigan

(57) ABSTRACT

A flexible cover assembly has five rectangular panels including a horizontal top panel, parallel vertical left and right side panels, and parallel vertical front and rear panels. Horizontal stitching joins the top panel and vertical panels. Vertical stitching joins the vertical panels. A vertical slit is centrally positioned on the rear panel with fasteners for coupling and uncoupling purposes. Adjustment mechanisms vary the effective size of the cover to fit the size of associated devices including swimming pool heaters, heat pumps, air conditioners and the like.

1 Claim, 3 Drawing Sheets

FIG. 1
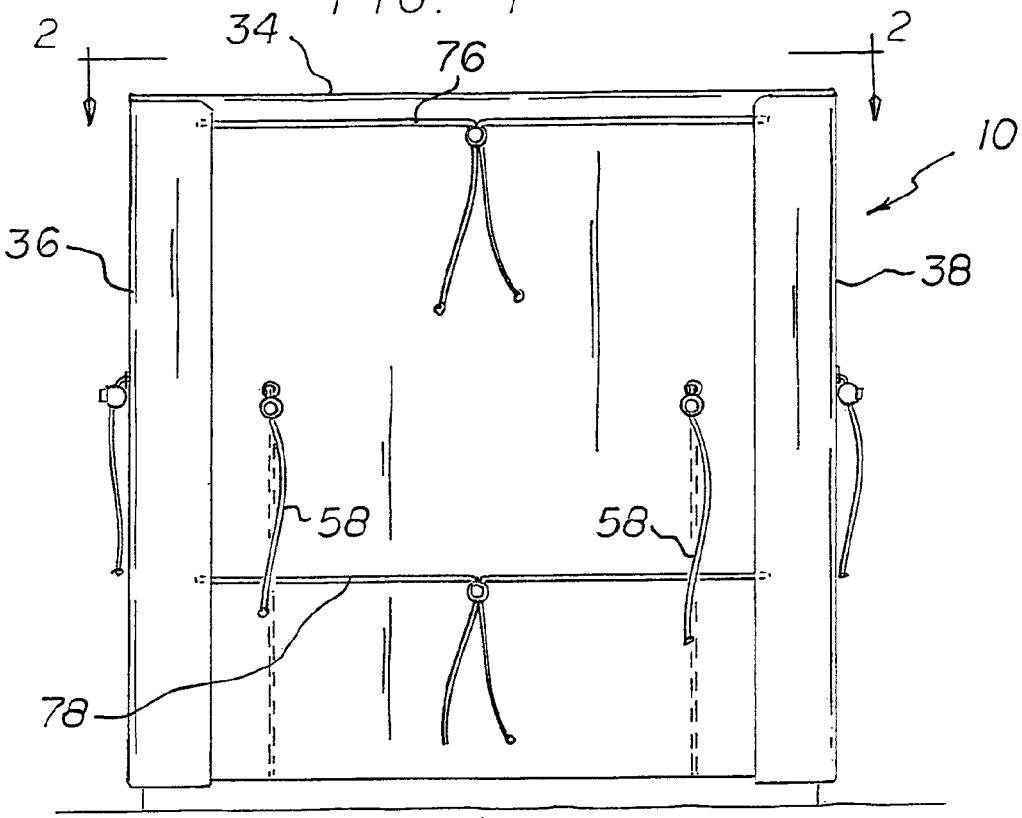
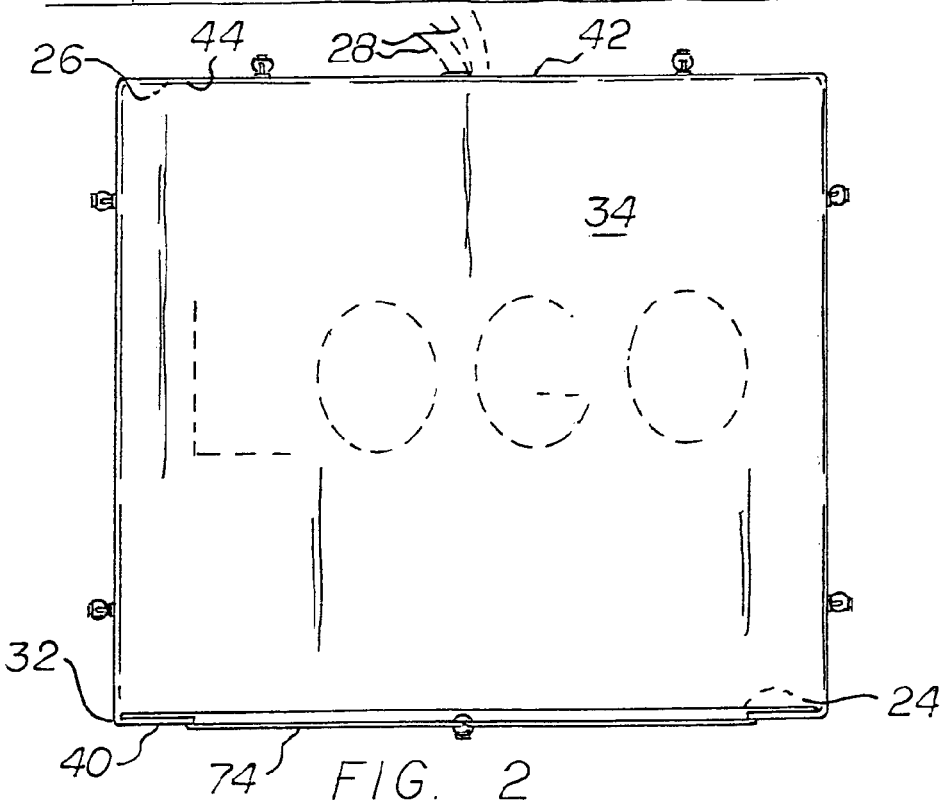
FIG. 2

FIG. 3
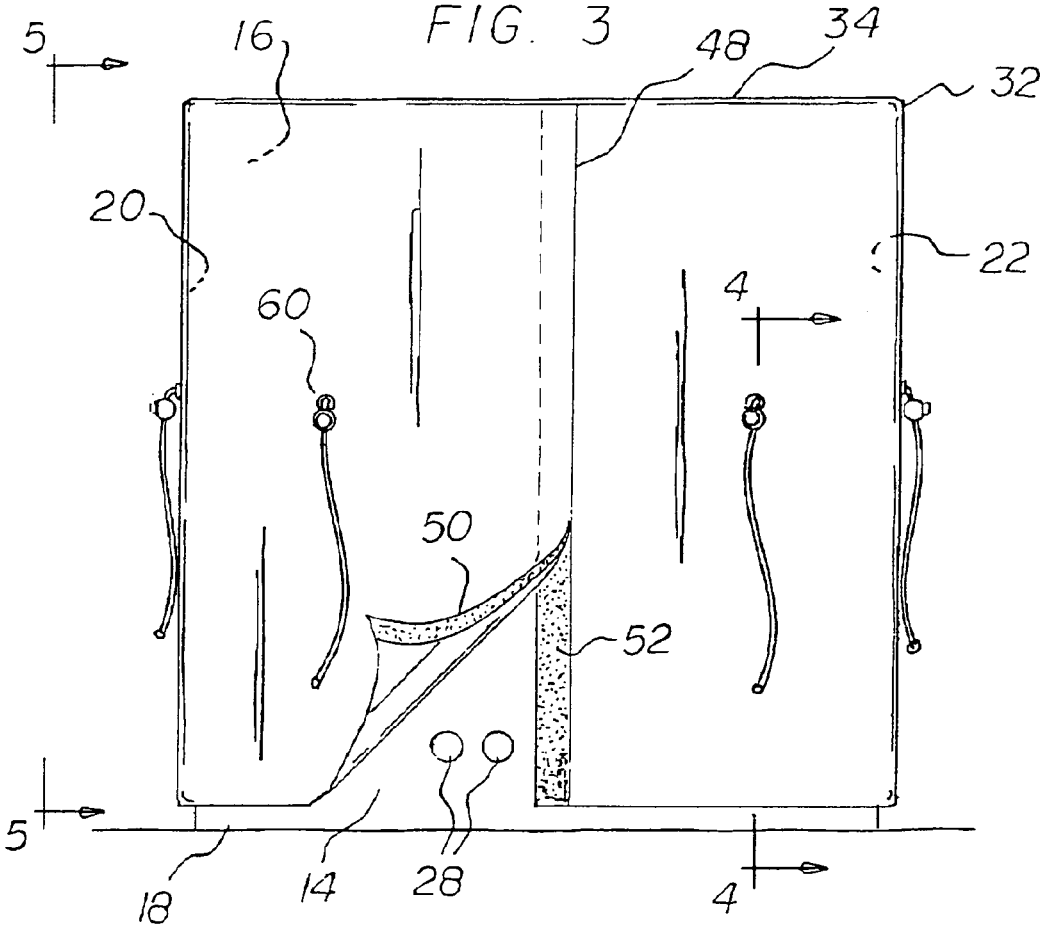
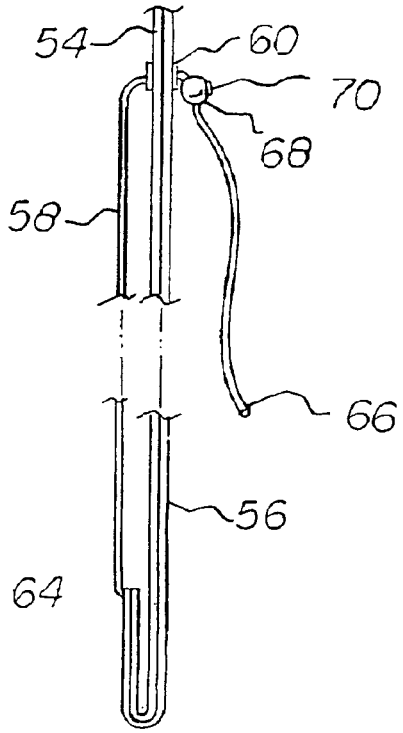
FIG. 4

FIG. 5
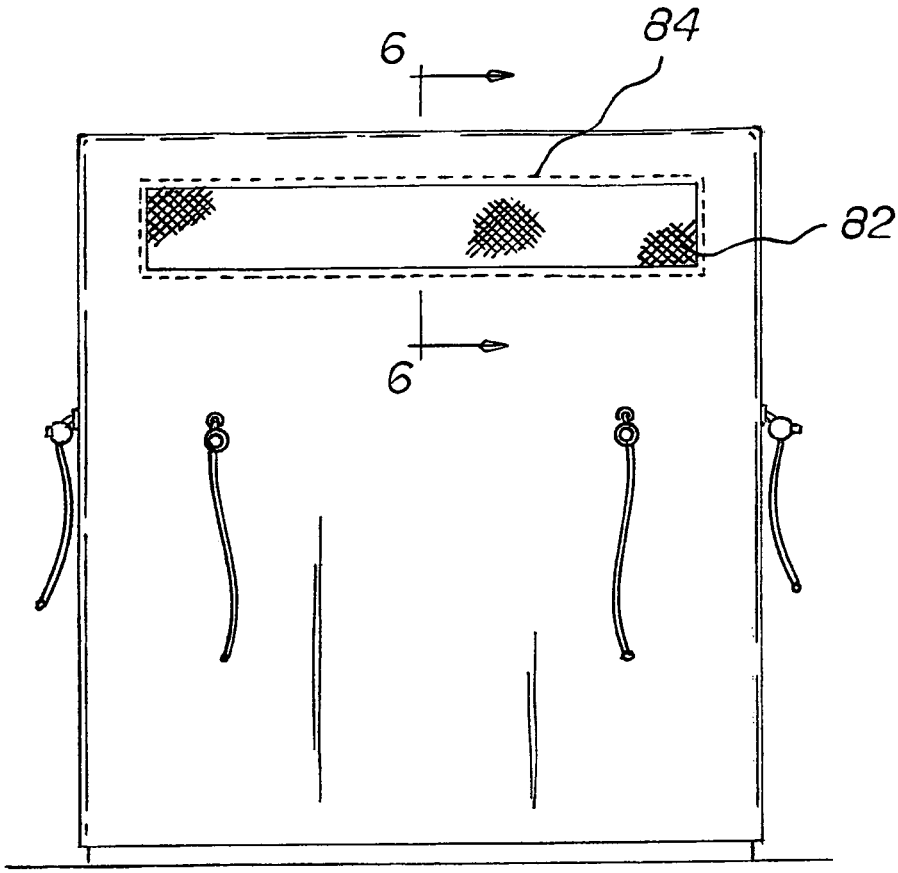
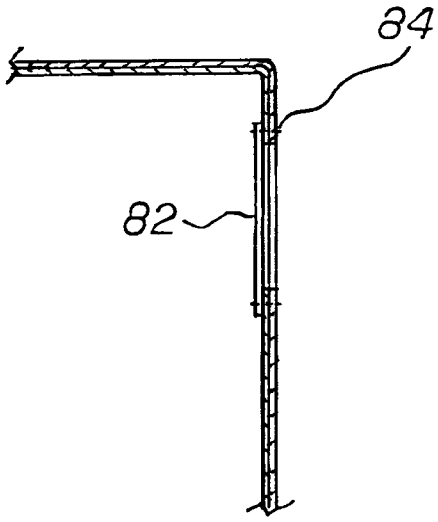
FIG. 6

ADJUSTABLE SWIMMING POOL HEATER COVER SYSTEM

BACKGROUND OF THE INVENTION

1. Field of the Invention

The present invention relates to an adjustable swimming pool heater cover system and more particularly pertains to covering a swimming pool heater and for providing protection from the elements while not being used for extended periods of time, the covering and protecting being done in a safe, convenient and economical manner.

2. Description of the Prior Art

The use of cover systems of known designs and configurations is known in the prior art. More specifically, cover systems of known designs and configurations previously devised and utilized for the purpose of protecting pool heaters from the elements are known to consist basically of familiar, expected, and obvious structural configurations, notwithstanding the myriad of designs encompassed by the crowded prior art which has been developed for the fulfillment of countless objectives and requirements.

While the prior are devices fulfill their respective, particular objectives and requirements, they do not describe an adjustable swimming pool heater cover system that allows for covering a swimming pool heater and for providing protection from the elements while not being used for extended periods of time, the covering and protecting being done in a safe, convenient and economical manner.

In this respect, the adjustable swimming pool heater cover system according to the present invention substantially departs from the conventional concepts and designs of the prior art, and in doing so provides an apparatus primarily developed for the purpose of covering a swimming pool heater and for providing protection from the elements while not being used for extended periods of time, the covering and protecting being done in a safe, convenient and economical manner.

Therefore, it can be appreciated that there exists a continuing need for a new and improved adjustable swimming pool heater cover system which can be used for covering a swimming pool heater and for providing protection from the elements while not being used for extended periods of time, the covering and protecting being done in a safe, convenient and economical manner. In this regard, the present invention substantially fulfills this need.

SUMMARY OF THE INVENTION

In view of the disadvantages inherent in the known types of cover systems of known designs and configurations now present in the prior art, the present invention provides an improved adjustable swimming pool heater cover system. As such, the general purpose of the present invention, which will be described subsequently in greater detail, is to provide a new and improved adjustable swimming pool heater cover system and method which has all the advantages of the prior art and none of the disadvantages.

To attain this, the present invention essentially comprises an adjustable swimming pool heater cover system. First provided is a swimming pool heater. The swimming pool heater is in a rectilinear configuration. The swimming pool heater has a horizontal rectangular upper surface. The swimming pool heater has a parallel rectangular lower surface. The lower surface is positioned upon a recipient surface. The swimming pool heater has vertically oriented surfaces. The vertically oriented surfaces couple the upper and lower surfaces. The vertically oriented surfaces include a left side surface and a parallel right side surface. The vertically oriented surfaces also include a front surface and parallel rear surface. The rear surface has lines. The pool heater is adapted to be a conventional pool heater or a heat pump.

A flexible cover assembly is provided. The cover assembly has five rectangular panels. The panels include a horizontal top panel. The top panel has a rectangular periphery. The top panel is positioned upon the upper surface of the swimming pool heater. The panels include parallel vertical left and right side panels. The side panels are positioned over the left and right side surfaces. The panels include parallel front and rear panels. The front and rear panels are positioned over the front and rear surfaces. Horizontal stitching is provided. In this manner the periphery of the top panel is joined to the left side panel and the front panel and right side panel and the rear panel panels. Vertical stitching is provided. In this manner the left side panel is joined to the front panel to the right side panel to the rear panel to the left side panel. A vertical slit is provided. The vertical slit is centrally positioned on the rear panel. Hook and loop fastener are provided. The hook and loop fastener is provided for coupling and uncoupling purposes. In this manner coupling and uncoupling the cover to the swimming pool heater is facilitated. The panels all have an inner layer. The inner layer has a non-woven liner. The panels all have an outer layer. The outer layer is of a durable vinyl.

Adjustment mechanisms are provided next. In this manner the height and the circumference of the cover may be varied to fit the size of the swimming pool heater.

The adjustment mechanisms include a height adjuster. The height adjuster is formed of a pair of laterally spaced grommets. The grommets extend through each vertical panel at a generally central elevation. An elevating cord is provided. The elevating cord has a central extent. The central extent extends through an associated grommet. Each elevating cord extends vertically downwardly. Each elevating cord has a lower end. The lower end is attached to a vertical panel at a lower extent interior of the cover. Each elevating cord has an upper end. The upper end is provided exterior of the cover. The upper end is adapted to be repositioned by a user for adjusting the height of the cover. A ball-shaped clip is provided. The ball-shaped clip has a release depressable button. In this manner the elevating cord is retained at a preselected orientation as a function of the height of the swimming pool heater.

The adjusting mechanisms also includes a circumference adjuster. The circumference adjuster has upper horizontal cords. The circumference adjuster has lower horizontal cords. The upper horizontal cords are located at elevation above the grommets on opposite sides of the slit. The lower horizontal cords are located at elevation below the grommets on opposite sides of the slit. The cords are adapted to contract and expand the circumference of the cover as a function of the circumference of the swimming pool heater when cinched by a user.

Lastly, a breathable section of a woven nylon material is formed in each side panel with stitching coupling the breathable sections to the side panels. Each breathable section is located in an upper extent of an associated side panel and constituting between 6 and 12 percent of an area of each side panel.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved adjustable swimming pool heater cover system which has all of the advantages of the prior art cover systems of known designs and configurations and none of the disadvantages.

It is another object of the present invention to provide a new and improved adjustable swimming pool heater cover system which may be easily and efficiently manufactured and marketed.

It is further object of the present invention to provide a new and improved adjustable swimming pool heater cover system which is of durable and reliable constructions.

An even further object of the present invention is to provide a new and improved adjustable swimming pool heater cover system which is susceptible of a low cost of manufacture with regard to both materials and labor, and which accordingly is then susceptible of low prices of sale to the consuming public, thereby making such adjustable swimming pool heater cover system economically available to the buying public.

Even still another object of the present invention is to provide an adjustable swimming pool heater cover system for covering a swimming pool heater and for providing protection from the elements while not being used for extended periods of time, the covering and protecting being done in a safe, convenient and economical manner.

Lastly, it is an object of the present invention to provide a new and improved adjustable device cover system. A flexible cover assembly has five rectangular panels including a horizontal top panel, parallel vertical left and right side panels, parallel vertical front and rear panels. Horizontal stitching joins the top panel and vertical panels. Vertical stitching joins the vertical panels. A vertical slit is centrally positioned on the rear panel with fasteners for coupling and uncoupling purposes. Adjustment mechanisms vary the effective size of the cover to fit the size of associated devices including swimming pool heaters, heat pumps, air conditioners and the like.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of an adjustable pool heater cover system constructed in accordance with the principles of the present invention.

FIG. 2 is a plan view of the adjustable pool heater cover system taken along line 2-2 of FIG. 1.

FIG. 3 is a rear elevational view of the system shown in FIGS. 1 and 2.

FIG. 4 is a cross sectional view taken along line 4-4 of FIG. 3.

FIG. 5 is a side elevational view if the of the system shown in the prior Figures.

FIG. 6 is a cross sectional view taken along line 6-6 of FIG. 5.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved adjustable swimming pool heater cover system embodying the principles and concepts of the present invention and generally designated by the reference numeral 10 will be described.

The present invention, the adjustable swimming pool heater cover system 10 is comprised of a plurality of components. Such components in their broadest context include a flexible cover assembly and adjustment mechanisms. Such components are individually configured and correlated with respect to each other so as to attain the desired objective.

First provided is a swimming pool heater 14. The swimming pool heater is in a rectilinear configuration. The swimming pool heater has a horizontal rectangular upper surface 16. The swimming pool heater has a parallel rectangular lower surface 18. The lower surface is positioned upon a recipient surface. The swimming pool heater has vertically oriented surfaces 20, 22, 24, 26. The vertically oriented surfaces couple the upper and lower surfaces. The vertically oriented surfaces include a left side surface 20 and a parallel right side surface 22. The vertically oriented surfaces also include a front surface 24 and parallel rear surface 26. The rear surface has lines 28. The pool heater is adapted to be a conventional pool heater or a heat pump.

A flexible cover assembly 32 is provided. The cover assembly has five rectangular panels. The panels include a horizontal top panel 34. The top panel has a rectangular periphery. The top panel is positioned upon the upper surface of the swimming pool heater. The panels include parallel vertical left and right side panels 36, 38. The side panels are positioned over the left and right side surfaces. The panels include parallel front and rear panels 40, 42. The front and rear panels are positioned over the front and rear surfaces. Horizontal stitching 44 is provided. In this manner the periphery of the top panel is joined to the left side panel and the front panel and right side panel and the rear panel panels. Vertical stitching 46 is provided. In this manner the left side panel is joined to the front panel to the right side panel to the rear panel to the left side panel. A vertical slit 48 is provided. The vertical slit is centrally positioned on the rear panel. Hook and loop fastener 50, 52 are provided. The hook and loop fastener is provided for coupling and uncoupling purposes. In this manner coupling and uncoupling the cover to the swimming pool heater is facilitated. The panels all have an inner layer 54. The inner layer has a non-woven liner. The panels all have an outer layer. The outer layer is of a durable vinyl 56.

Adjustment mechanisms are provided next. In this manner the height and the circumference of the cover may be varied to fit the size of the swimming pool heater.

The adjustment mechanisms include a height adjuster. The height adjuster is formed of a pair of laterally spaced grommets 60. The grommets extend through each vertical panel at a generally central elevation. An elevating cord 58 is provided. The elevating cord has a central extent. The central extent extends through an associated grommet. Each elevating cord extends vertically downwardly. Each elevating cord has a lower end 64. The lower end is attached to a vertical panel at a lower extent interior of the cover. Each elevating cord has an upper end 66. The upper end is provided exterior of the cover. The upper end is adapted to be repositioned by a user for adjusting the height of the cover. A ball-shaped clip 68 is provided. The ball-shaped clip has a release depressable button 70. In this manner the elevating cord is retained at a preselected orientation as a function of the height of the swimming pool heater.

The adjusting mechanisms also includes a circumference adjuster 74. The circumference adjuster has upper horizontal cords 76. The circumference adjuster has lower horizontal cords 78. The upper horizontal cords are located at elevation above the grommets on opposite sides of the slit. The lower horizontal cords are located at elevation below the grommets on opposite sides of the slit. The cords are adapted to contract and expand the circumference of the cover as a function of the circumference of the swimming pool heater when cinched by a user.

As set forth above, the preferred material for the panels includes an inner layer of a non-woven liner and an outer layer of a durable vinyl. In an alternate embodiment of the invention, at least one of the panels, preferably the two side panels, is constructed with breathable sections 82 of a breathable fabric such as a woven nylon material. Stitching 84 couples the breathable sections to the panels. Each breathable section is preferably located in an upper extent of an associated side panel and constitutes between 6 and 12 percent of the area of each side panel. The use of the breathable fabric substantially restricts moisture from entering the cover but allows for the flow of fresh air to enter the space between the panels and the device being covered thus moisture build up under the cover is substantially reduced. This, in turn, abates rusting and other undesirable effects on the device.

Although the primary embodiment of the present invention is an adjustable cover for a swimming pool heater, it should be understood that the present invention is an adjustable cover adapted for use with a wide range of associated devices including heat pumps, air conditioners and the like As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An adjustable swimming pool heater cover system (10) adapted to cover a swimming pool heater and for providing protection from the elements while not being used for extended periods of time, the system consisting of:

a swimming pool heater (14) in a rectilinear configuration, the swimming pool heater having a horizontal rectangular upper surface (16) and a parallel rectangular lower surface (18) positioned upon a recipient surface, the swimming pool heater having vertically oriented surfaces (20), (22), (24), (26) coupling the upper and lower surfaces, the vertically oriented surfaces including a left side surface (20) and a parallel right side surface (22), the vertically oriented surfaces also including a front surface (24) and parallel rear surface (26), the rear surface having lines (28) for the passage of refrigerant there through;

a flexible cover assembly (32) having five rectangular panels including a horizontal top panel (34) with a rectangular periphery positioned upon a periphery of the upper surface of the swimming pool heater, parallel vertical left and right side panels (36), (38) positioned over the left and right side surfaces, parallel front and rear panels (40), (42) positioned over the front and rear surfaces, horizontal stitching (44) joining the periphery of the top panel to the left side panel and the front panel and right side panel and the rear panel panels, vertical stitching (46) joining together the left side panel to the front panel to the right side panel to the rear panel to the left side panel, a vertical slit (48) centrally positioned on the rear panel with a hook and loop fastener (50), (52) for coupling and uncoupling of the slit to facilitate coupling and uncoupling the cover to the swimming pool heater, the panels all having an inner layer (54) of a non-woven liner and an outer layer of a durable vinyl (56);

adjustment mechanisms for varying a height and a circumference of the cover to fit the size of the swimming pool heater;

the adjustment mechanisms including a height adjuster formed of a pair of laterally spaced grommets (60) extending through each vertical panel at a generally central elevation, an elevating cord (58) having a central extent extending through an associated grommet, each elevating cord extending vertically downwardly with a lower end (64) attached to a vertical panel at a lower extent interior of the cover, each elevating cord having an upper end (66) exterior of the cover and adapted to be repositioned by a user for adjusting the height of the cover, a ball-shaped clip (68) with a release depressable button (70) for retaining the elevating cord at a preselected orientation as a function of the height of the swimming pool heater;

the adjusting mechanisms including a circumference adjuster (74) formed of upper horizontal cords (76) and lower horizontal cords (78), the upper horizontal cords located at elevation above the grommets on opposite sides of the slit, the lower horizontal cords located at elevation below the grommets on opposite sides of the slit, the cords adapted to contract and expand the circumference of the cover as a function of the circumference of the swimming pool heater when cinched by a user; and a breathable section (82), being a cutout portion of the durable vinyl and non-woven liner, said breathable section consists of a woven nylon material in each side panel with stitching (84) coupling the breathable sections to the side panels, each breathable section being located in an upper extent of an associated side panel and constituting between 6 and 12 percent of an area of each side panel.

* * * * *